United States Patent [19]

Bowman et al.

[11] Patent Number: 4,848,013

[45] Date of Patent: Jul. 18, 1989

[54] TWO PIN FASTENING ASSEMBLY WITH INTERCONNECTING AND RETAINING MEANS

[75] Inventors: David E. Bowman; Mark S. Diekevers, both of East Peoria; William J. Renski, Peoria, all of Ill.

[73] Assignee: Caterpillar Inc., Peoria, Ill.

[21] Appl. No.: 261,853

[22] Filed: Oct. 24, 1988

[51] Int. Cl.[4] ..... E02F 9/28; F16D 1/00

[52] U.S. Cl. ..... 37/142 A; 403/223; 403/379

[58] Field of Search ..... 37/141 R, 141 T, 142 R, 37/142 A; 403/378, 379, 300, 305, 309, 313, 223, 225, 228; 285/321, 319, 320, 340, 921

[56] References Cited

U.S. PATENT DOCUMENTS

| | | | |
|---|---|---|---|
| 3,327,994 | 6/1967 | Carl | 403/305 X |
| 3,463,521 | 8/1969 | Helton | 37/142 A X |
| 3,588,154 | 6/1971 | Voight et al. | 403/300 |
| 3,884,508 | 5/1975 | Jones | 285/320 X |
| 3,952,433 | 4/1976 | Heinold et al. | 37/142 A |
| 4,123,091 | 10/1978 | Cosentino et al. | 285/319 X |
| 4,245,920 | 1/1981 | Barrett | 403/305 |
| 4,326,348 | 4/1982 | Emrich | 37/142 R |
| 4,613,172 | 9/1986 | Schattmaier | 285/320 X |
| 4,773,474 | 9/1988 | Stay | 285/319 X |

FOREIGN PATENT DOCUMENTS

| | | | |
|---|---|---|---|
| 972195 | 1/1951 | France | 37/142 A |

*Primary Examiner*—Charles Pearson
*Assistant Examiner*—Moshe I. Cohen
*Attorney, Agent, or Firm*—J. W. Burrows

[57] ABSTRACT

In ground engaging tools, reliable fastening devices are needed to quickly and effectively secure replaceable earth working tips to adapters. The fastening pin assembly should be configured in such a way as to prevent pin loss or breakage which causes the tip to be lost and/or the adapter damaged. This invention consists of two pins and an interconnecting and retaining means. When assembled, each pin will extend approximately to the middle portion of the adapter through axially aligned bores defined in both the tip and adapter. The interconnecting and retaining means is located in the middle portion of the adapter between the two pins and retains the pins in the adapter bore. This invention protects against pin loss/and or breakage and is beneficial to all type of earth working replaceable tip applications.

25 Claims, 4 Drawing Sheets

TWO PIN FASTENING ASSEMBLY WITH INTERCONNECTING AND RETAINING MEANS

TECHNICAL FIELD

This invention relates generally to ground engaging tools and more particularly to the attachment of replaceable earth working tips to adapters.

BACKGROUND ART

Ground engaging tools with replaceable tips, which are attached to adapters, are commonly used to loosen or break earth, rock, or other materials to aid in its removal. There are various pin fastening means available to attach the replaceable tip to the adapter. During light earth working activities these fastening means are acceptable. When a replaceable tip is subjected to very severe forces, such as found in rock quarry applications, the fastening pin(s) many times become dislocated from the adapter and tip or may be broken. In either case, the tip is released from the adapter and/or the adapter is damaged, costing the equipment owner valuable time and money.

One of the known fastening assemblies is shown in U.S. Pat. No. 601,911 to Donald L. Wood issued on Aug. 31, 1971. In this device, two pins are placed in the tip adapter bore. The pins are retained using a split lock ring disposed in a groove on the outer end of each pin. During operation in harsh environments, the severe forces imparted to the tip and adapter will generally break the pin in the groove area. The pins are also susceptible to pin loss when one or both of the pins are forced inwardly against the spring bias of the split lock ring thus allowing the pin to be dislodged from the bore. In either case, the tip is separated from the adapter and damage occurs.

Another known fastening assembly is provided in U.S. Pat. No. 3,959,901 to Gene Ralph Klett issued on June 1, 1976. arrangement consists of a single pin and a split lock ring, used to attach an earth working tip to an adapter. The pin extends through a bore in the adapter and tip. The pin is held in place by the frictional forces developed between the pin and the biasing force of the split lock ring which is located in a recess in the adapter. Although this assembly is functional in light to moderate applications, it is not totally adequate in demanding work environments. This combination is not as susceptible to pin breakage as reduced area pins. The assembly may be subject to pin loss due to the forces applied by the tip to the pin during certain extreme operations. As the working medium acts on the tip, the tip in turn exerts a force on the pin greater than the frictional force between the split lock ring and the pin. Consequently, the pin moves with respect to the split lock ring and after a period of operation the pin is no longer held in the adapter bore. The pin may also be driven out by the forces applied by the material being handled. With the pin removed, the tip is separated from the adapter and the adapter is damaged if operation U.S. Pat. No. 3,733,722 to Richard L. Launder issued May 22, 1973 a fastening assembly in which pins used. Each pin assembly is composed of a pair of bars joined by a rubber body and disposed in a bore in the adapter and tip. The pins are subjected to a pinching force on their outer ends which expands the inner ends to retain the pins in the bores. As the earth working device is used, the tip will cause the rubber body to flex. The body will either separate from the bars or fail internally from the flexing. This failure may be aided by the cutting, puncturing, or ripping of the rubber body by the material being handled. The failure could propagate throughout the body and cause it to fail. When the bars and body are no longer one unit, the pieces will fall out of the bore and the tip will no longer be attached to the adapter.

Fastening pin assemblies are used to provide a means to mount replaceable tips to adapters for material handling purposes. When the fastening assembly is not able to retain the tip to the adapter in even the most severe applications, due to its breakage or loss, it is no longer advantageous. The cost of replacing a tip or even a damaged adapter is far greater than the cost of the pin assembly. The fastening pin assembly must remain functional in all work environments.

The present invention is directed to overcoming one or more of the problems set forth above.

DISCLOSURE OF THE INVENTION

In one aspect of the present invention a fastening pin assembly includes a first fastening pin having an end portion, a second fastening pin having an end portion, and means for interconnecting the end portions of the first and second fastening pins and for retaining, when assembled, the first and second fastening pins in the adapter. The first and second fastening pins are axially aligned and their end portions juxtapose each other, when assembled.

In another aspect of the present invention a fastening pin assembly is provided in combination with a ground engaging tool. The combination includes an adapter having an end portion including first and second sides and a bore extending therethrough, a tip having a rearward end portion including first and second side walls partially defining a socket conformed to mate with the adapter forward end portion and a bore extending therethrough. The combination further includes a first fastening pin, a second fastening pin, and an interconnecting and retaining means. The first and second pins are slideably disposed within the adapter bore, extend from the adapter into the tip bore, and the end portions juxtapose in the adapter bore. The interconnecting and retaining means interconnects the end portions of the fastening pins in the bore.

The present invention provides a fastening pin assembly for the attachment of earth working tips to adapters for severe applications in which pin breakage and loss are prevalent. This invention overcomes the pin breakage problem by its unique use of the two fastening pins in combination with the interconnecting and retaining means. The pins do not have a reduced area near the bores of the critical adapter to tip interface. Furthermore, the fastening pins tend to remain in place even during severe operations due to their interaction through the interconnecting and retaining means. With this invention, the earth working tip will remain attached to the adapter even in the most rugged applications.

BEST MODE FOR CARRYING OUT THE INVENTION

Figure 1:
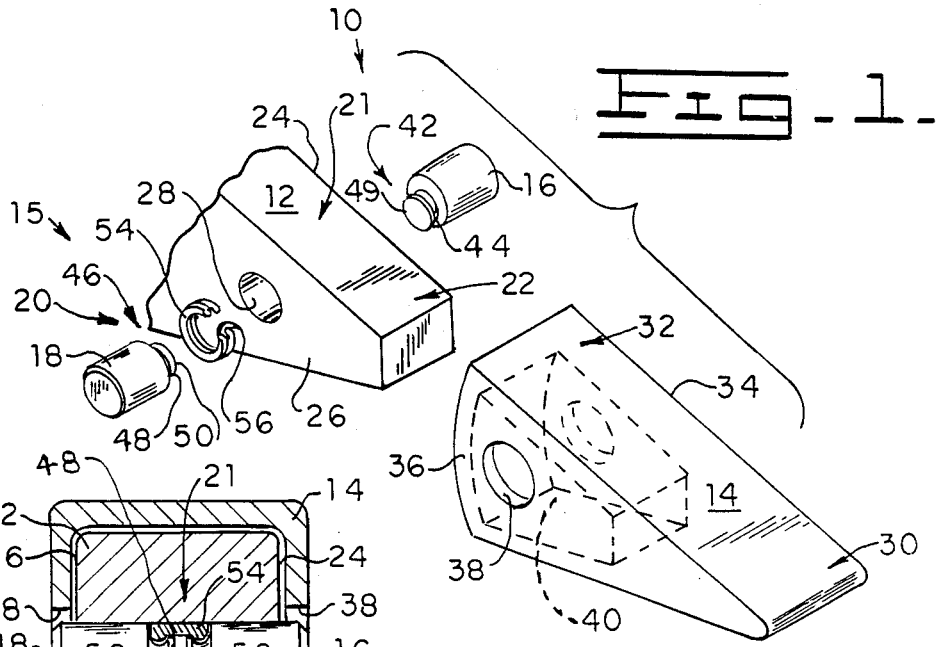
FIG. 1 is an isometric drawing illustrating an embodim of the present invention.
Figure 2:
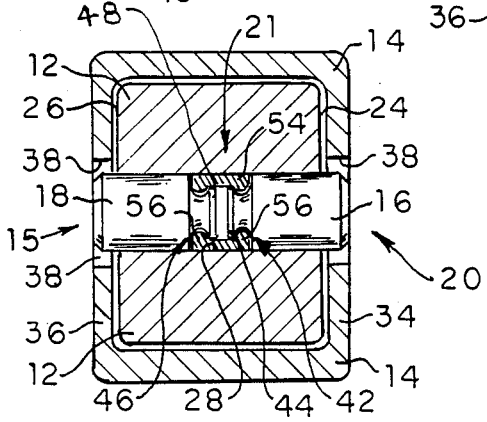
FIG. 2 is a cross-sectional view of FIG. 1 tak.en through and generally along the longitudinal axis of the pins with the earth working tip mounted on the adapter.

Referring now to the drawings and in particular to FIGS. 1 and 2, a ground engaging tool 10 is shown. The ground engaging tool 10 includes an adapter 12, an earth working tip 14, and a fastening pin assembly 15. The fastening pin assembly 15 includes a first fastening pin 16, a second fastening pin 18, and an interconnecting and retaining means 20.

The adapter 12 has a middle portion 21, an end portion 22, a first side 24, a second side 26, and defines a bore 28 extending through the adapter end portion 22 between the first and second sides 24,26. The bore 28 is illustrated as round, although it is recognized that other shapes could be used.

The tip 14 has a forward end portion 30 and a rearward end portion 32. The rearward end portion 32 has a first side wall 34, a second side wall 36, and defines a bore 38 through the side walls 34,36. A socket 40 is partially defined by the sidewalls 34,36 in the rearward portion 32 and is conformed to mate with the end portion 22 of the adapter 12. The bores 28,38 are generally axially aligned when the tip 14 is assembled with the adapter 12.

The first fastening pin 16 has a reduced diameter end portion 42 with a protuberance 44 thereon extending radially outwardly.

The second fastening pin 18 also has a reduced diameter end portion 46 with a protuberance 48 thereon extending radially outwardly. It can be seen from FIG. 2 that both the pins 16,18 are slideably disposed in the adapter bore 28 and extend into the tip bore 38. The end portions 42,46 also juxtapose each other when the pins 16,18 are located in the bores 28,38. It should be noted that the use of first and second in describing the fastening pins 16,18 is for understanding purposes only and is not part of the inventive concept.

The interconnecting and retaining means 20 in FIGS. 1 and 2 includes a generally cylindrical connector 54. The cylindrical connector 54 shown in FIGS. 1 and 2 is a split spring connector and is generally "C" shaped. The connector 54 frictionally fits into the bore 28 in the adapter middle portion 21 and has a pair of axially spaced projections 56 extending radially inward. The "C" shaped cylindrical connector 54 of this embodiment slips over the respective protuberances 44,48 of the first and second pins 16,18 and the projections 56 engage the respective protuberances on pins 16,18 to interconnect and retain the pins 16,18, either directly or indirectly, in the bores 28,38. It is recognized that the connector 54 could be replaced with more than one connector without deviating from the invention.

Figure 3:
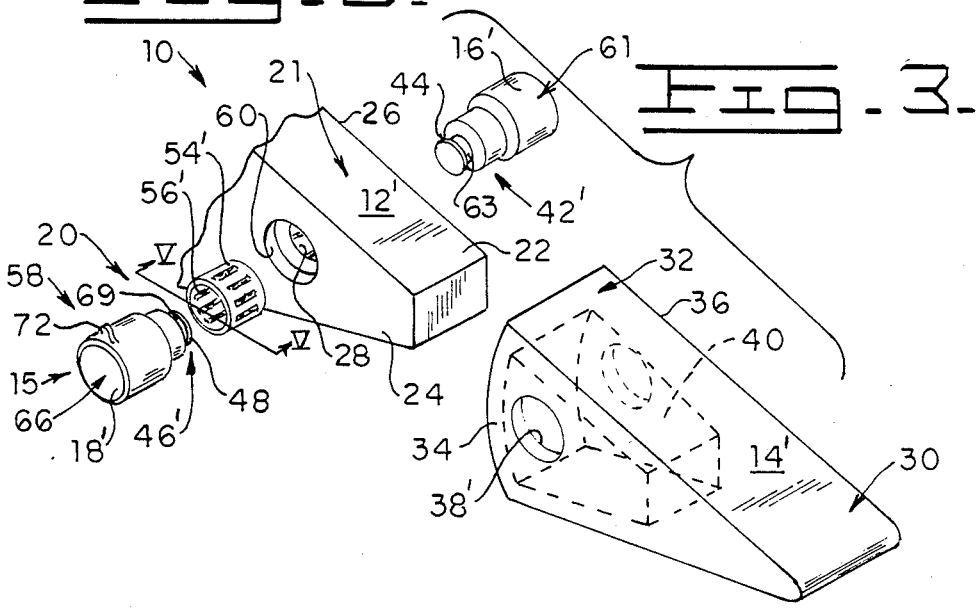
FIG. 3 is an isometric drawing showing another embodiment of the present invention.
Figure 4:
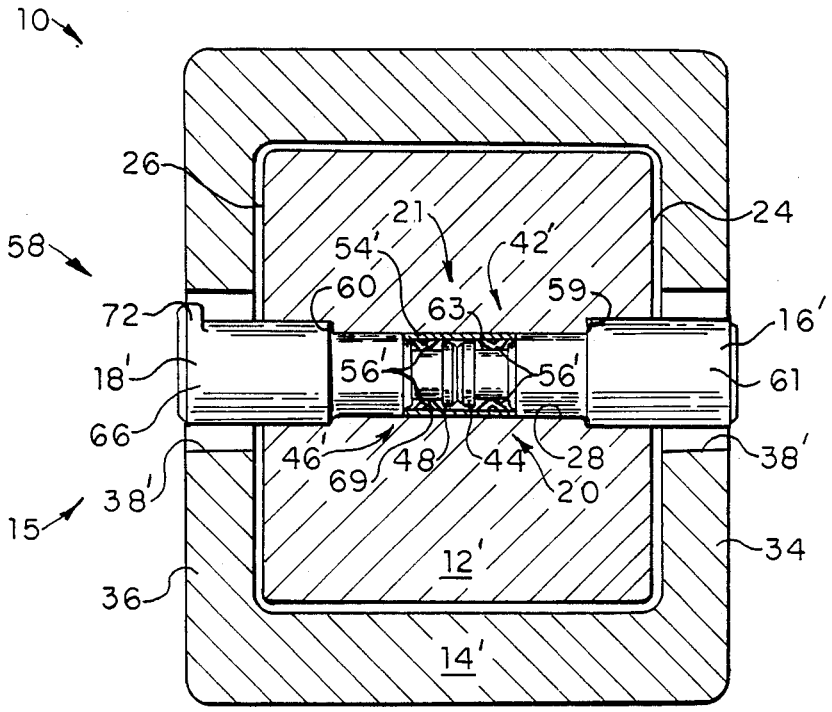
FIG. 4 is a cross-sectional view of FIG. 3 taken through and generally along the longitudinal axis of the pins with the earth working tip mounted on the adapter.
Figure 5:
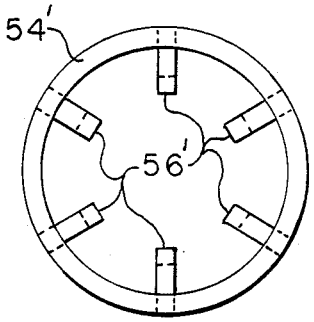
FIG. 5 is an end view of an element taken along line V—V of FIG. 3.

Relating now to FIG. 3, 4, and 5, a ground engaging tool 10 is shown illustrating another embodiment of the present invention. Like components will have like element numbers while similar components will have the same element number with primes attached thereto. The ground engaging tool 10 is comprised of an adapter 12', an earth working tip 14', and the fastening pin assembly 15. The fastening assembly 15 of FIGS. 3, 4, and 5 includes a first fastening pin 16', a second fastening pin 18', the interconnecting retaining means 20, and a removing means 58.

The adapter 12' includes the middle portion 21 and the end portion 22 with the first and second sides 24,26, the bore 28 extending through the adapter end portion 22, and a pair of counter bores 59,60 on the first and second sides 24,26 respectively.

The tip 14' includes the forward end portion 30 and the rearward portion 32. The rearward end portion 32 includes the first and second side walls 34,36 and defines a bore 38' through the side walls 34,36. The socket 40 is partially defined by the side walls 34,36 in the rearward end portion 32 and is conformed to mate with the end portion 22 of the adapter 12'. The bores 28,38' generally aligned when the 14' is assembled the adapter 12'.

The first fastening pin 16' has a reduced diameter end portion 42' and an enlarged portion 61 opposite the end portion 42'. A recess 63 is defined on the end portion 42' forms the protuberance 44.

The second fastening pin 18' also has a reduced diameter end portion 46' an enlarged end portion 66 opposite the end portion 46'. A recess 69 is defined on the end portion 46' and forms the protuberance 48. It can be see from FIG. 4 that both the pins 16', 18' are slideably disposed in the adapter bore 28 an into the tip bore 38'. The end portions 42', 46' also juxtapose each other when the pins 16', 18' located in the bores 28,38'.

The interconnecting and retaining 20 in FIGS. 3, 4, and 5 includes a generally cylindrical connector 54' the enlarged end portions 61,66. The connector 54', as depicted in FIGS. 3, 4 and 5, is loose fit in bore 28 in the adapter middle portion 21 and has a plurality of axially spaced resilient projections 56', extending radially inward around its circumference. The projections 56' extend into the recesses 63,69 for engagement with the respective protuberances 44, 48 to interconnect and retain the pins 16', 18', either directly or indirectly, in the bores 28,38'. The enlarged end portions 61,66 are seated in the counter bores 59,60 and are operative in conjunction with the connector 54' to interconnect and retain the pins 16',18' in the bores 28,38'.

The removing means 58 of this embodiment includes a tang 72 extending radially outwardly from one of the enlarged end portions 61,66 of the fastening pins 16',18'.

Figure 6:
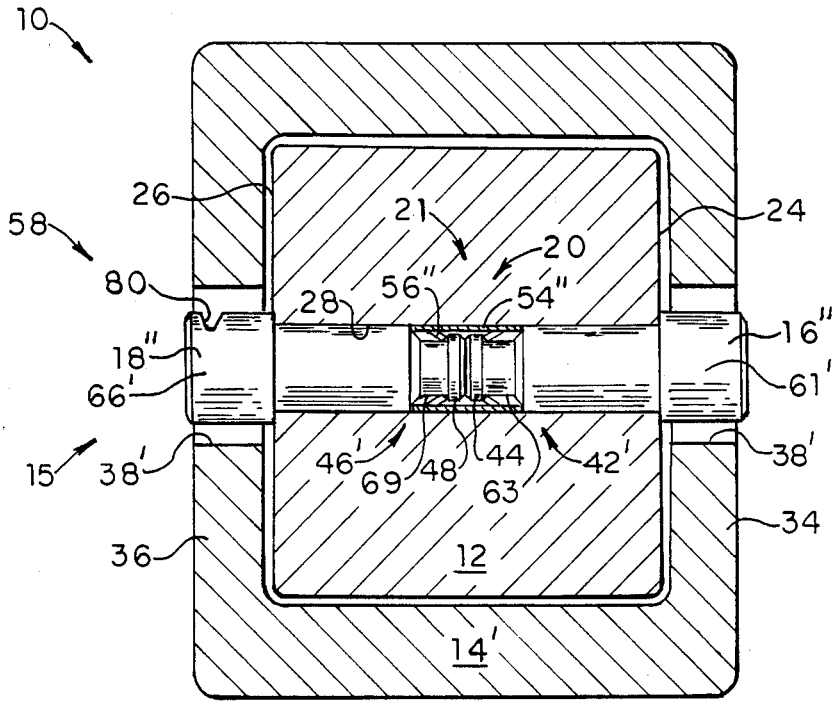
FIG. 6 is a cross-sectional view showing another embodiment of the invention.
Figure 7:
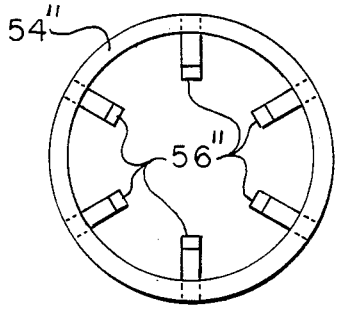
FIG. 7 is an end view of an alternate embodiment of the element taken along line V—V of FIG. 3 and more clearly shown in FIG. 6.

Referring now to FIGS. 6 and 7, still another embodiment is shown. Like components will have like element numbers while similar components will have the same element number with prime indicators attached thereto. The ground engaging tool 10 including the adapter 12, the earth w-rking tip 14' and the fastening pin assembly 15. The fastening pin assembly 15 of FIGS. 6 and 7 includes a first fastening pin 16'', a second fastening pin 18'', the interconnecting and retaining means 20, and the removing means 58. The removing means 58 of this embodiment is a groove 80 formed on one of the enlarged end portions 61',66' of the fastening pins 16'', 18''.

The adapter 12 includes the middle portion 21 and the end portion 22 with the first and second sides 24,26, and defines the bore 28 which extends through the adapter end portion 22.

The tip 14' includes the forward end portion 30 and the rearward and portion 32. The rearward end portion 32 includes the first and second side walls 34,36, and defines the bore 38' through the side walls 34,36. The socket 40 is partially defined by the side walls 34,36 in the rearward end portion 32 and is conformed to mate with the end portion 22 of the adapter 12. The bores 28,38 are generally aligned when the tip 14', is assembled with the adapter 12.

The first fastening pin 16'' has the reduced diameter end portion 42' and an end portion 61' opposite the end portion 42'. The recess 63 is defined on the end portion 42' and forms the protuberance 44.

The second fastening pin 18'' has the reduced diameter end portion 46' enlarged end portion 66' opposite the end portion 46'. The recess 69 is defined on the end portion 46' forming the protuberance 48.

It can be seen from FIG. 6 that both the pins 16'',18'' are slideably disposed in the adapter bore 28 extend into the tip bore 38'. The end portions 42',46' also juxtapose each when the pins 16'',18'' located in the bores 28,38'.

The intercopnnecting and retaining means 20 in FIG. 6 includes a generally cylindrical connector 55'' and the enlarged end portions 61',66'. The connector 54'', as depicted in FIGS. 6 and 7, is loose fit in the bore 28 of the adapter middle portion 21, and has a plurality of axially spaced resilient projections 56'' extending radially inwardly around its circumference. The projections 56'' extend into the recesses 63,69 for engagement with the respective protuberances 44,48 of the end portions 42',46' to interconnect and retain the pins 16'',18'', either directly or indirectly, in the bores 28,38'. The resilient projections 56'' shown in FIGS. 6 and 7 are of the one use only type'', since the projections 56'' are bent inward and the ends thereof contact the protuberances 44,48 and must be bent or broken in order to disassemble the pins 16'', 18'' from the connector 54''. The resilient projections 56' of FIGS. 3, 4 and 5 are designed to be reused since the projections 56' are shaped so that when they engage the protuberances 44,48, they spring outwardly and spring back once the projections 56' the respective recesses 63,69. The same events occur, but in reverse order, during disassembly. The enlarged ends 61', 66' of FIG. 6 are seated against the adapter 12 to also aid in interconnecting and retaining the pins 16'',18'' in the bores 28,38', either directly or indirectly.

Figure 8:
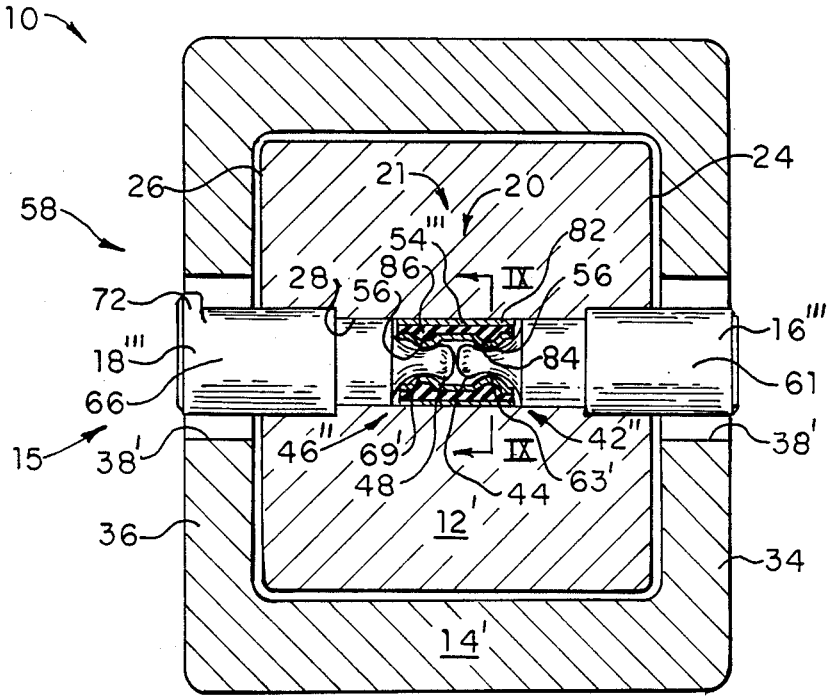
FIG. 8 is a cross-sectional view showing another embodiment of the present invention.
Figure 9:
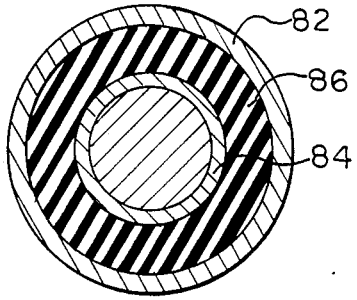
FIG. 9 is a partial cross-sectional view taken generally along line IX—IX of FIG. 8.

Referring now to FIGS. 8 and 9, yet another embodiment is shown. Like components will have like element numbers while similar components will have the same element numbers with prime indicators attached thereto. The ground engaging tool 10 includes the adapter 12', the earth working tip 14' and the fastening pin assembly 15. The fastening pin assembly 15 of FIGS. 8 and 9 includes a first fastening pin 16''', a second fastening pin 18''', the interconnecting and retaining means 20, and the removing means 58.

The ground engaging tool of this embodiment also includes the adapter 12' and the tip 14' that is adapted for mating with the end portion 22 of the adapter 12'.

The first and second fastening pins 16''',18''' each has a respective reduced diameter end portion 42'',46'' and enlarged end end portions 61,66 opposite the respective end portions 44'',46''. A recess 63' is defined on the end portion 42'' and forms the protuberance 44 while a recess 69' defined on the end portion 46'' and forms the protuburance 48. It can be seen from FIG. 8 that both the pins 16''',18''' are slideably disposed in the adapter bore 28 and extend into the tip bore 38'. The end portions 42'',46'' also juxtapose each other when the pins 16''',18''' are located in the bores 28,38'.

The interconnecting and retaining means 20 in FIG. 8 includes a generally cylindrical connector 54''' and the enlarged end portions 61,66. The connector 54''', as depicted in FIGS. 8 and 9, is loose fit in the bore 28 of the adapter middle portion 21 and includes an outer cylindrical member 82, an inner cylindrical member 84, and an elastomer 86 disposed between and bonded to each of the inner and outer cylindrical members 82,84. The pair of axially spaced and inwardly extending projections 56 of this embodiment are part of the inner cylindrical member 84. The projections 56 extend into the recesses 63',69' for engagement with the respective protuberances 44,48 to interconnect and retain the pins 16''',18'''.

Industrial Applicability

Ground engaging tools 10, which use the earth working tip 14 attached to the adapter 12, are subjected to many varying types of external forces. In particular, when the ground engaging tool 10 is used in rock quarries, the forces exerted on the fastening pin assembly are severe. By using two fastening pins 16,18 in conjunction with an interconnecting and retaining means 20, the pins 16,18 will not be broken. Furthermore, the fastening pins 16,18 tend to aid each other in their retention in the adapter bore 28.

In the combination illustrated in FIGS. 1 and 2, the earthworking tip 14 is assembled with the adapter 12. The first and second fastening pins 16,18 are connected by way of the cylindrical connector 54. More specifically, the respective end portions 42,46 are inserted into the connector 54 through the "C" shaped opening and the protuberances 44,48 contact the projections 56 to prohibit linear disassembly. The fastening pin assembly 15 is then driven through the tip bore 38 and into the adapter bore 28. Once assembled, the fastening pins 16,18 extend through both the adapter 12 and the tip 14 to retain the tip 14 on the adapter 12. The pins 16,18 are held in the bore 28 by the connector which is frictionally fit into the adapter bore 28. When a force is encountered which tries to remove one of the pins 16,18 from the adapter bore 28, the radial flange 49,50 on that pin's end portion 42,46 reacts by trying to expand the projections 56 to allow the protuberance 44,48 to escape from the connector 54. The expanding of the connector 54 adds to the force which is holding it in place. Thus, the connector 54 is held in place and the pins 16,18 retained.

A force which tends to break the conventional fastening pins is resisted by decreasing the pin's bending moment and eliminating any abrupt diametric changes near the interface of the tip bore 38 and the adapter bore 28. This embodiment uses two fastening pins 16,18 which cut the bending moment approximately in half. It also has no change in diameter near the interface of the tip and adapter bores 28,38. This concept helps reduce tip loss due to pin breakage.

The tip 14 can be removed from the adapter 12 by driving the fastening pin assembly out using hard continuous blows to one end of the fastening pin assembly 15.

In the second combination illustrated in FIGS. 3 and 4, the earth working tip 14, is mated to the adapter 12'

. The first and second fastening pins 16',18' are connected by the cylindrical connector 54'. One of the fastening pins 16',18' is assembled with the connector 54' by engaging the resilient projections 56' with the grooved end portion 42', 46', One of the 16',18' and the connector 54' are then placed loosely into the adapter bore 28. The respective enlarged end portion 61,66 is seated into the respective counter bore 59,60 and extends into the tip bore 38' . The other pin 16',18' is then assembled, from the opposite direction with the connector in the manner as stated above. With the fastening pin assembly 15 in place, the tip 14' is secured to the adapter 12' . Any forces which try to dislodge one or both of fastening pins 16',18' from their proper location is resisted. For example, any inwardly pressing force will be resisted by the respective enlarged end portion 61,66 coming in contact with the respective adapter counterbore 59,60. Likewise, any force trying to pull one of the pins 16,18 out is resisted by the enlarged end portions 61,66 of the other pin and the cylindrical connector 54'

.

After these forces dissipate, which they usually do quickly, the induced forces on the resilient projections 56' the pin to move back into its normal position. Pin breakage is further prevented by the enlarged end portions 61,66 being located within the interface between the adapter 12' and the ti 14'. The tip 14' can be removed from the adapter 12' simply by prying one pin from the bores 28',38', using the tang 72 (FIG. 4) or the groove 80 (FIG. 6), and a constant prying force. The remaining pin 16,18 can then be removed easily by hand.

The combination, illustrated in FIGS. 6 and 7, is similar to the combination in FIGS. 3 and 4 above. The benefits and the mode of operation are the same as above. The difference between the two embodiments is the enlarged end portions 61',66' FIG. 6 are seated against the adapter sides 24,26 as opposed to being seated in the counter bores 59,60 as shown in FIGS. 3 and 4. Also the connector 54" can only be used one time since the resilient projections 56" are normally broken or permanently deformed during disassembly. Conversely the connector 54' can be used multiple times since the resilient projections 56' are flexible and curved in shape so that they move over the protuberances 44,48 during both assembly and disassembly.

The combination, illustrated in FIGS. 8 and 9, is similar to the combination in FIGS. 3 and 4 above. The difference between the two embodiments is the connector 54''' has the elastomer 86 disposed behind the inner cylindrical member. This allows the respective projections 56 on the first and second pins 16''',18''' to move outward during assembly so that the respect projection 56 slips over the respective protuberance 44,48 into the respective recess 63',69'. Disassembly of the pin assembly 15 occurs in the same manner but in the reverse direction. Consequently, the connector 54''' may be reused.

The fastening pin assembly 15, as illustrated in the various embodiments, provides a retaining mechanism that is generally simple in construction and easy to assemble and disassemble. By having two pins as opposed to one, pin breakage is basically eliminated. Furthermore, the use of two pins each having an enlarged portion 61/61',66/66' held together by a common connector 54'/54"/54" provides the opportunity to use a small diameter bore in the adapter. Thus reducing the weakness in the adapter caused by the bore and maintaining a larger diameter at the interface of the tip bore and the adapter bore. Since most forces acting to force the pin from the bore are inward forces, the enlarged end portions 61/61',66/66' are very effective in offsetting such forces. This also enables the connector 54'/54"/54''' to be more economically made. For example, the connectors may be made from thin spring metal or from a plastic material. This makes this arrangement a very practical one to use, even in rugged applications.

Other aspects, objects, and advantages of this invention can be obtained from study of the drawings, the disclosure, and the appended claims.

We claim:

1. A fastening pin assembly adapted for use with an earth working tip and an adapter, comprising:

a first fastening pin having an end portion;

a second fastening pin having an end portion, wherein said fastening pins are axially aligned and said end portion of said second fastening pin juxtaposes the end portion of said first fastening pin when assembled; and means for engaging and interconnecting the end portions of the first and second fastening pins and for retaining, when assembled, the first and second pins in the adapter.

2. The fastening pin assembly, as defined in claim 1, wherein the interconnecting and retaining means includes a connector having a pair of axially spaced projections extending radially inwardly for engagement with said end portions when assembled.

3. The fastening pin assembly, as defined in claim 2, wherein the end portion of the first and second fastening pins each have a recess defined by the end portion and positioned when assembled to receive said projections.

4. The fastening pin assembly, as defined in claim 3, wherein the end portion of the first and second fastening pins each have a radially outwardly extending protuberance operative when assembled to engage said projections.

5. The fastening pin assembly, as defined in claim 4, wherein said connector is generally cylindrical.

6. The fastening pin assembly, as defined in claim 5, wherein said connector includes a plurality of projections.

7. The fastening pin assembly, as defined in claim 4, wherein said first and second fastening pins each have an enlarged end portion opposite said end portion.

8. The fastening pin assembly, as defined in claim 7, wherein said projections are circumferentially spaced.

9. The fastening pin assembly, as defined in claim 8, wherein said fastening pin includes an enlarged end opposite said end portion and a tang extending radially outward from said enlarged end portion.

10. The fastening pin assembly, as defined in claim 9, wherein said projections are resilient.

11. The fastening pin assembly, as defined in claim 7, wherein said connector has a radially outer cylindrical member, an inner cylindrical member, and an elastomer disposed between and bonded to each of the inner and outer cylindrical members, the axially spaced projections are defined on the inner cylindrical member and operative when assembled to engage the respective radially outwardly extending protuberances on the first and second fastening pins.

12. A ground engaging tool comprising:

an adapter having a middle portion and an end por including first and second sides and a bore extending therethrough;

a tip having a forward end portion and a rearward end portion, said rearward end portion having first and second side walls partially defining a socket conformed to mate with the adapter end portion, and a bore extending through the first side wall and the second side wall and being in general alignment with said adapter bore;

a first fastening pin having an end portion, said first pin being slideably disposed within said adapter bore and extends from said adapter first side into said tip bore;

a second fastening pin having an end port said second pin being slideably disposed within said adapter bore and extends from said adapter second side into said tip bore and the end portion of said second fastening pin juxtaposes the end portion of said first fastening pin; and means for engaging and interconnecting the end portions of the first and second fastening pins generally in the middle portion of the adapter bore and for retaining the first and second fastening pins in said bores.

13. The ground engaging tool, as defined in claim 12, wherein the end portions of the first and second fastening pins each have a radially outwardly extending protuberance, said interconnecting and retaining means includes a generally cylindrical connector having a pair of axially spaced projections extending radially inwardly for engagement with the protuberances.

14. The ground engaging tool, as defined in claim 13, wherein the end portions of the first and second fastening pins each have a recess defined by the end portion, said interconnecting and retaining means includes a generally cylindrical connector having a pair of axially spaced projections extending radially inwardly into the recess for operative engagement with the end portions.

15. The ground engaging tool, as defined in claim 14, wherein said interconnecting and retaining means includes an enlarged end portions on said first and second fastening pins, opposite said end portions, the enlarged end portions when assembled being in contact with said adapter.

16. The ground engaging tool as set forth in claim 15, wherein said connector has a radially outer cylindrical member, an inner cylindrical member, and an elastomer disposed between and bonded to each of the inner and outer cylindrical members, the axially spaced projections are defined on the inner cylindrical member and operative when assembled to engage the respective radially outwardly extending protuberances on the first and second fastening pins.

17. The ground engaging tool, as defined in claim 15, wherein said adapter bore has a counter bore on said first and second sides and said enlarged end portions are seated in the counter bores.

18. The ground engaging tool, as defined in claim 14, wherein said connector is frictionally fit in said adapter bore.

19. The ground engaging tool, as defined in claim 15, wherein said connector includes a plurality of projections.

20. The ground engaging tool, as defined in claim 17, wherein said projections are circumferentially spaced.

21. The ground engaging tool, as defined in claim 20, wherein said projections are resilient.

22. The ground engaging tool, as defined in claim 21, wherein said connector is loose fit in said adapter bore.

23. The ground engaging tool, as defined in claim 22, including means for removing said fastening pin.

24. The ground engaging tool, as defined in claim 23, wherein said removing means includes a tang extending radially outward from one of the enlarged end portions.

25. The ground engaging tool, as defined in claim 23, wherein said removing means includes a groove defined in one of the enlarged and portions.

* * * * *

UNITED STATES PATENT AND TRADEMARK OFFICE

CERTIFICATE OF CORRECTION

PATENT NO. : 4,848,013

DATED : July 18, 1989

INVENTOR(S) : DAVID E. BOWMAN ET AL.

It is certified that error appears in the above-identified patent and that said Letters Patent is hereby corrected as shown below:

Abstract, line 14, delete "/and" and insert --and/--

Abstract, line 15, delete "type" and insert --types--

Claim 12, column 9, line 1, delete "por" and insert --portion--

Claim 12, column 9, line 15, delete "port" and insert --portion,--

Claim 25, column 10, line 39, delete "and" and insert --end--

Signed and Sealed this

Fifth Day of June, 1990

*Attest:*

HARRY F. MANBECK, JR.

*Attesting Officer*

*Commissioner of Patents and Trademarks*